US007748879B2

(12) United States Patent
Koike et al.

(10) Patent No.: US 7,748,879 B2
(45) Date of Patent: Jul. 6, 2010

(54) VEHICLE LAMP

(75) Inventors: Teruo Koike, Tokyo (JP); Yasushi Yatsuda, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 142 days.

(21) Appl. No.: 10/826,276

(22) Filed: Apr. 19, 2004

(65) Prior Publication Data

US 2004/0223338 A1 Nov. 11, 2004

(30) Foreign Application Priority Data

Apr. 25, 2003 (JP) ..... 2003-122090
Sep. 12, 2003 (JP) ..... 2003-320694

(51) Int. Cl.
*F21S 8/10* (2006.01)

(52) U.S. Cl. ..... 362/487; 362/507; 362/539

(58) Field of Classification Search ..... 362/487, 362/517, 518, 519, 507, 539, 538, 545, 548, 362/549, 241, 243, 247, 800
See application file for complete search history.

(56) References Cited

U.S. PATENT DOCUMENTS

| | | | | |
|---|---|---|---|---|
| 1,536,006 | A * | 4/1925 | Howard | 362/280 |
| 3,633,022 | A * | 1/1972 | Sassmanshausen | 362/327 |
| 4,654,629 | A * | 3/1987 | Bezos et al. | 246/473.3 |
| 4,928,214 | A * | 5/1990 | Oyama | 362/518 |
| 5,688,042 | A * | 11/1997 | Madadi et al. | 362/240 |
| 5,890,794 | A * | 4/1999 | Abtahi et al. | 362/294 |
| 6,371,636 | B1 * | 4/2002 | Wesson | 362/545 |
| 6,565,247 | B2 | 5/2003 | Thominet | 362/545 |
| 6,814,475 | B2 * | 11/2004 | Amano | 362/487 |
| 7,048,412 | B2 * | 5/2006 | Martin et al. | 362/247 |
| 2001/0010634 | A1 * | 8/2001 | Yokoi | 362/512 |
| 2001/0019486 | A1 | 9/2001 | Thominet | 362/543 |
| 2003/0103348 | A1 | 6/2003 | Hung | 362/247 |
| 2003/0227774 | A1 | 12/2003 | Martin et al. | 362/240 |
| 2004/0213014 | A1 * | 10/2004 | Koike | 362/545 |
| 2004/0223338 | A1 | 11/2004 | Koike et al. | 362/545 |

FOREIGN PATENT DOCUMENTS

| | | | |
|---|---|---|---|
| EP | 1 298 383 | | 4/2003 |
| EP | 1 371 901 | | 12/2003 |
| JP | 63-6516 | | 1/1988 |
| JP | 9-265807 | | 10/1997 |
| JP | 10-83709 | | 3/1998 |
| JP | 10-294006 | | 11/1998 |
| JP | 2002-008413 | | 1/2002 |
| JP | 2002-100217 | | 4/2002 |
| JP | 2003-31007 | | 1/2003 |
| JP | 2003-31011 | | 1/2003 |
| WO | WO02/52190 | | 4/2002 |
| WO | WO 02/052190 | * | 7/2002 |

* cited by examiner

*Primary Examiner*—Sharon E Payne
(74) *Attorney, Agent, or Firm*—Kenealy Vaidya LLP

(57) ABSTRACT

A vehicle lamp can include a plurality of light sources and reflective surfaces in various combinations. Each light source can include at least one LED array that includes or consists of LED chips arranged in a row. Each reflective surface can be arranged in combination with a light source to generate a certain light distribution pattern. Two to twelve or more such combinations of light sources and reflective surfaces can be employed. The lights having light distribution patterns generated from the combinations can be combined to form an overall light distribution pattern.

26 Claims, 5 Drawing Sheets

VEHICLE LAMP

This invention claims the benefit of Japanese Patent Application No. 2003-122090, filed on Apr. 25, 2003, and Japanese Patent Application No. 2003-320694, filed on Sep. 12, 2003 which are both hereby incorporated by reference.

BACKGROUND OF THE INVENTION

1. Field of the Invention

The present invention relates to a lamp and is mainly aimed at vehicle lighting, such as a headlamp, a turn lamp, a front fog, spot or driving lamp and a reverse lamp. More particularly, it relates to a vehicle lamp including a plurality of LED lamps (or one or more LED lamps each with a plurality of LED chips mounted thereon) as light sources. A single LED lamp often provides an insufficient amount of light for particular applications.

2. Description of the Related Art

In a conventional vehicle lamp that employs LED lamps as light sources, the LED lamps are arranged such that each of their optical axes is directed to the apex of a cone. In addition, a cylindrical optical guide is attached to each LED lamp such that the light from all the LED lamps converges on the apex. A reflective surface of the hyperboloid of revolution is arranged near the apex to convert the light beams from the LED lamps into a single light beam, as if it is emitted from a single point. This is effective to form a light distribution pattern at a main reflective surface of the hyperboloid of revolution and compensate for an insufficient amount of light sometimes produced by a single LED lamp (see for example Japanese Patent Application Publication No.: JP-A-2002/100217).

In the above conventional configuration, however, in addition to the optical guide, a casing and others structures are attached to the LED chip contained in each of the LED lamps that are arranged in a ring. Accordingly, this configuration is limited in the number of LED lamps that can be integrated, and the lamp still produces an insufficient amount of light for certain applications. For example, there are problems and difficulties associated with incorporating the lamp into a vehicle lamp that requires a much larger amount of light, such as a headlight.

During manufacture and assembly, high accuracy is required to ensure the mutual positional accuracy of both the optical guide with the reflective surface of the hyperboloid of revolution, and the reflective surface of the hyperboloid of revolution with the main reflective surface. This requirement causes problems because it complicates the processing and manufacturing steps, which elevates the cost of the vehicle lamp.

If the number of the LED lamps is increased, the reflective surface combined with a plurality of light sources causes spots of light, resulting in a difficulty in the formation of proper light distribution characteristics. In addition, such a configuration causes variations in illumination on the road surface, deteriorating the illumination quality and lowering the visibility. These and other problems are considered as subjects to be solved.

SUMMARY OF THE INVENTION

A first aspect of the present invention is directed to a lamp, and more particularly a vehicle lamp that includes a plurality of light sources and reflective surface reflectors positioned in different combinations. Such a lamp can illuminate a predetermined area by emitting light that forms a predetermined light pattern, as required by a particular application. Each light source can include at least one LED array with LED chips arranged in a row along a line. Each reflective surface can be arranged in combination with a light source to reflect a beam from the light source to generate a certain light distribution pattern. Light having light distribution patterns generated from the combinations can be superimposed so that the light forms a predetermined light distribution pattern as required for the lamp's application. The number of the combinations is often equal to two or more and generally twelve or less.

Another aspect of the present invention is directed to a vehicle lamp as described above, wherein the light source preferably includes a light source holder shaped in a substantially polygonal form having a longitudinal axis in a direction parallel with an optical axis of the lamp, or a beam emitted from the lamp. In this case, each side of the light source holder can have an LED array arranged thereon matching the row direction thereof and in a direction parallel with the longitudinal axis. The reflective surfaces can be located such that they surround the light source holder. This is one of the basic aspects of the invention.

Another aspect of the present invention is directed to a vehicle lamp with a light source that can include a light source holder shaped in a substantially polygonal form having a longitudinal axis in a direction parallel with a beam emitted from the lamp. In this case, each side of the light source holder preferably has an LED array arranged thereon. Each LED array can be arranged in an adjusted row direction such that a projected image of a light distribution pattern formed by light reflected from the reflective surface combined with the light source that contains the LED array is determined so that a projected image has a longitudinal axis in a direction substantially parallel with a horizontal line. Application of such a configuration can make a large contrast in intensity of illumination between light and dark parts of the light distribution at a light/dark boundary, which is advantageous for a low beam light distribution when the lamp is configured as a headlamp.

Another aspect of the present invention is directed to a vehicle lamp as described above, wherein the light source can include a shade that is configured to block a part of the light emitted from the light source. The shade can be arranged in the vicinity of the light source and in an optical path extending from the light source to the reflective surface to form a predetermined light distribution pattern as required or desired for the lamp. Application of such a configuration can achieve a light distribution that is tilted with its left side up for illumination of the roadside. Alternatively, it can achieve a light distribution for illumination of a relatively narrow range below a horizontal line in front of a vehicle when the lamp is configured as a headlamp.

Another aspect of the present invention is directed to a vehicle lamp as described above in which the shade is located at a position in the lateral direction of the light source holder on the side of the light source holder and in a direction substantially perpendicular to the longitudinal axis thereof. Application of such a configuration can achieve a light distribution for illumination of a relatively narrow range below a horizontal line in front of a vehicle when the lamp is configured as a headlamp.

Another aspect of the present invention is directed to a vehicle lamp as described above, in which at least one of the LED arrays can include a cylindrical lens having a longitudinal axis that is parallel to or identical to an axis that contains a row of LEDs of the LED array. Application of such a configuration can change an emission angle of the light emitted from the LED array to be much wider or narrower, as desired.

Another aspect of the present invention is directed to a vehicle lamp as described above, in which the vehicle lamp can be configured to adjust the number or positions of the LED chips that are turned on in each array or between arrays so as to vary the light distribution pattern as required or desired for the lamp. A plurality of basic light distribution patterns may be provided in the vehicle lamp in accordance with laws and regulations. The basic light distribution pattern may be changed during operation of the vehicle, or plural basic light distribution patterns may be switched between each other. In such a case, a larger number of LED arrays than is required for the basic light distribution patterns may be employed, if required. In this case, it is effective to adjust the number or positions of the LED chips that are to be turned on in each array or between arrays to vary the light distribution pattern required or desired for the lamp.

Another aspect of the present invention is directed to a vehicle lamp as described above, in which the LED array or the LED chip is tilted with respect tot the optical axis of the lamp and in a direction relative to the reflective surface. Application of such a configuration can reduce the depth of the reflective surface and accordingly the diameter thereof and downsize the whole vehicle lamp without a reduction of the amount of illumination.

The lamp of the present invention can include a plurality of light sources and reflective surfaces in combinations. Each light source can include at least one LED array that includes or consists of LED chips that are arranged in a row. Each reflective surface can be arranged in combination with a light source to reflect a beam from the light source and to generate a certain light distribution pattern. Preferably, two to twelve such combinations of light sources and reflective surfaces can be employed. The light having light distribution patterns generated from these combinations can be combined to form an overall light distribution pattern. The LED arrays or light sources are preferably formed on respective sides of the light source holder that is shaped in a substantially polygonal prism having a longitudinal axis in a direction along the emission direction from the vehicle lamp. The reflective surfaces can be located such that they surround the light source holder. In a vehicle lamp thus configured, a particularly large number of LED arrays that are employed as light sources can be integrated in a narrower area as compared to the conventional lamp. This is extremely effective in providing a sufficient amount of light when the LEDs are employed as the light sources, and therefore can provide a lamp such as a headlight.

BRIEF DESCRIPTION OF THE DRAWINGS

The present invention will be more fully understood from the following detailed description with reference to the accompanying drawings, in which.

DETAILED DESCRIPTION OF PREFERRED EMBODIMENTS

The present invention provides a lamp, and more particularly a vehicle lamp that can include a plurality of LED arrays and reflective surfaces in combinations. Each LED array can include or consist of a plurality of LED chips arranged in a row. Each reflective surface can be combined with a corresponding light source. Two to twelve combinations of LED arrays and reflective surfaces can be employed, and the light distribution patterns generated from the combinations can be integrated to form an overall light distribution characteristic for the vehicle lamp.

Figure 1:
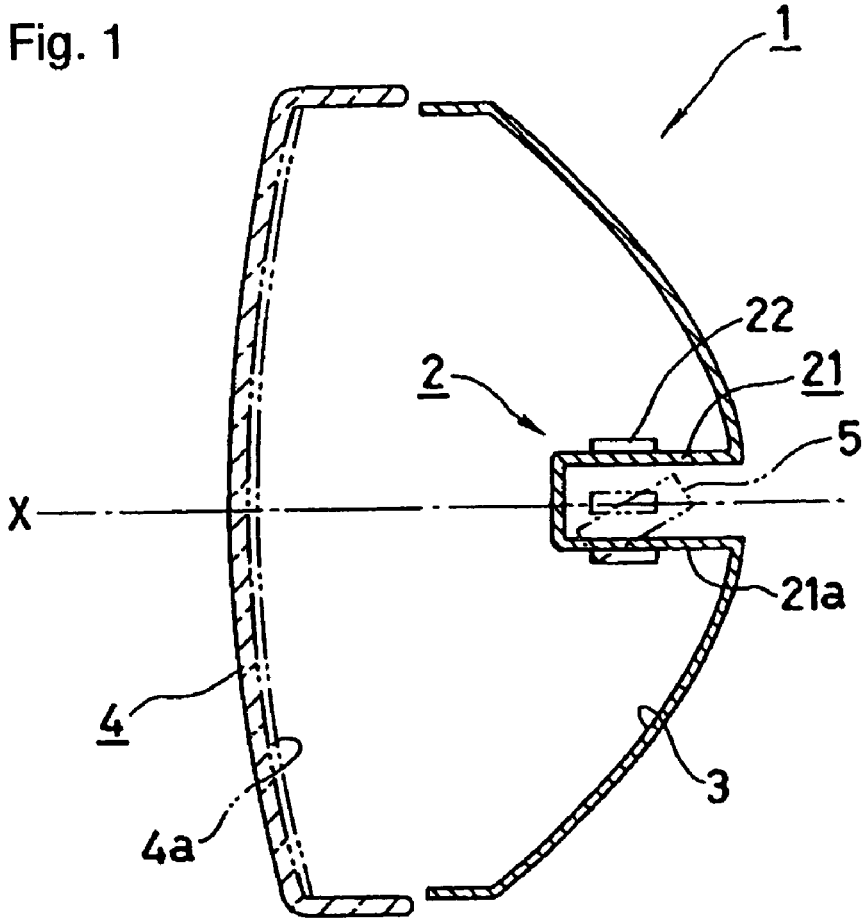
FIG. 1 is a cross-sectional view showing a vehicle lamp made in accordance with the principles of the present invention.

The present invention will be described next in detail with reference to various preferred embodiments shown in the figures. A vehicle lamp 1 made in accordance with the principles of the invention is shown in FIG. 1. The vehicle lamp 1 can include a light source 2, a reflective surface 3, and a lens 4. A shade 5 may be provided additionally, if desired or required. The reflective surface preferably includes a parabolic reflective surface such as a paraboloid of revolution.

Figure 2:
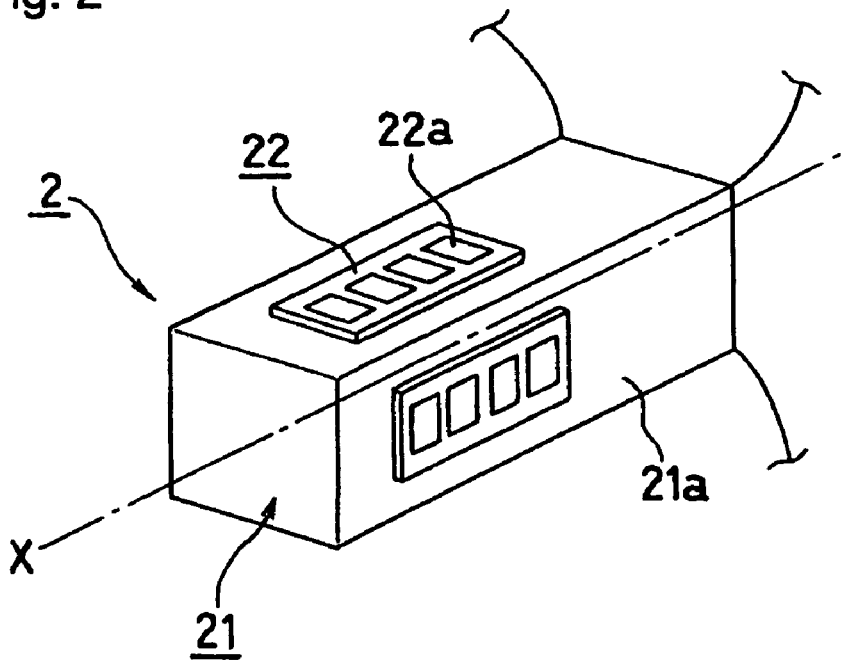
FIG. 2 is a perspective view showing the light source holder of the lamp of FIG. 1.
Figure 3:
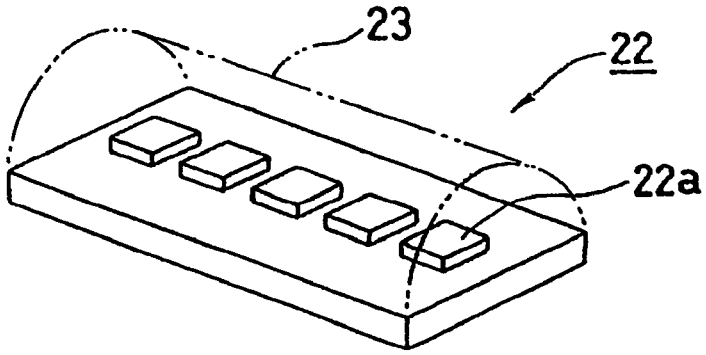
FIG. 3 is an illustrative view showing an LED array of the vehicle lamp of FIG. 1.

FIGS. 2 and 3 show a configuration of the light source 2. In this embodiment the light source can include a light source holder 21 shaped in a substantially quadrangular prism, and LED arrays 22 can be provided on four sides 21*a* of the light source holder 21, respectively. A cylindrical lens 23 may be provided additionally, if desired or required. The present invention is not intended to limit the number of sides for the light source holder 21. For example, a triangular prism, a pentagonal prism, a hexagonal prism or other polygonal prisms with any number of sides, even more than six, may be used.

As described above, the light source holder 21 can be formed as a substantially quadrangular prism-like structure, which has a longitudinal axis that is substantially coincident with an optical axis X of the vehicle lamp 1. In this embodiment the sides 21*a* of the light source holder 21 can also have axes that are parallel with the optical axis X. In addition, the light source holder 21 preferably has a square cross-section and, when it is attached to the vehicle, two of the sides 21*a* can be located above and below a horizontal line and two other sides can be located on the left and right of a vertical line. This embodiment is explained under such conditions.

The LED array 22 can be attached on the side 21*a* of the light source holder 21, as a major part thereof is shown in FIG. 3, aligning plural LED chips 22*a* along a line. The LED chips 22*a* are preferably aligned in the direction along the longitudinal axis of the side 21*a*, that is, the optical axis X of the vehicle lamp 1.

The reflective surface 3, the projection lens 4 and the shade 5 can be employed later to form a light distribution pattern as desired or required for the vehicle lamp 1. In this case, the light emitted from the LED array 22 may be required to have a larger emission angle or a narrower emission angle. In accordance with such a requirement, the cylindrical lens 23 may be provided on the LED array 22 such that the longitudinal axis of the lens 23 is substantially parallel with the optical axis X.

Thus, the formation of the LED array 22 with a plurality of LED chips 22*a* enables a much larger number of LED chips 22*a* to be arranged in the same area to increase the amount of light as compared to the conventional arrangement of plural LED lamps. In addition, the present invention can further increase the amount of light because the number of LED arrays 22 that can be provided is at least equal to or greater than the number of sides 21*a* of the light source holder 21.

In the light source 2 thus configured, one LED array 22 (one side 21*a*) corresponds to one reflective surface 3. If the light source holder 21 is configured to have four sides 21*a* (four LED arrays 22) as is in this embodiment, the reflective surface 3 can be configured to have a tetrapetalous shape corresponding to the sides 21*a* (see FIG. 4).

In this embodiment, each reflective surface 3 can be a paraboloid, such as a paraboloid of revolution and a paraboloidal free-form surface, having a focus on a corresponding LED array 22. Therefore, the light from the LED array 22 is basically led into the lens 4 as a collimated light substantially parallel with the optical axis X and, through the lens cut 4*a* located on the lens 4, the light is diffused in a lateral direction and adjusted for emission orientation.

Figure 4:
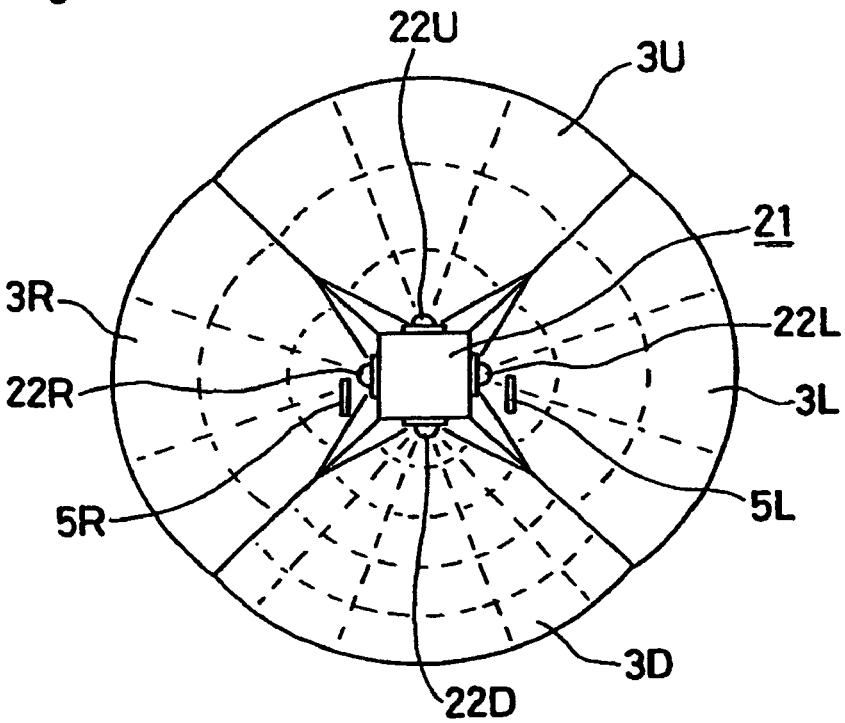
FIG. 4 is an illustrative view showing LED arrays and corresponding reflective surfaces of the vehicle lamp of FIG. 1.
Figure 5:
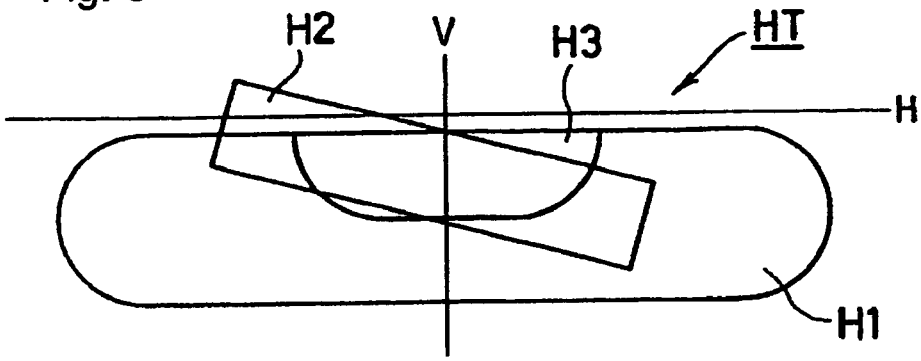
FIG. 5 is an illustrative view showing a formation of light distribution patterns for the vehicle lamp of FIG. 1.

FIGS. 4 and 5 show the formation of light distribution patterns HT for the vehicle lamp 1 of FIG. 1. The LED arrays 22U and 22D can be located on the upper and lower sides of the light source holder 21, and the corresponding reflective surfaces 3U and 3D can be employed to form a light distribution pattern H1. This pattern illuminates a wide range in the lateral direction below a horizontal line (see FIG. 5).

The LED array 22L (located at the left side in a horizontal direction when viewing the vehicle lamp 1 from the driver's seat), the corresponding reflective surface 3L, and the shade 5L located in the vicinity of the LED array 22L can be employed to form a light distribution pattern H2. This pattern is tilted with its left side up for illumination of the roadside (see FIG. 5).

In addition, the LED array 22R (located at the right side in a horizontal direction), the corresponding reflective surface 3R, and the shade 5R can be employed to form a light distribution pattern H3. This pattern illuminates a relatively narrower range below the horizontal line in front of the vehicle (see FIG. 5). A combination of the light distribution patterns H1, H2 and H3 can provide an overall light distribution pattern that forms a low beam distribution pattern which is excellent for visibility without providing dazzling or glaring light to oncoming cars.

The relation between the LED array 22 and the reflective surface 3 that forms each light distribution pattern described above is considered as follows. As described above, the LED array 22 preferably faces the reflective surface 3 such that the direction parallel with the optical axis X becomes the longitudinal direction of the array. Therefore, the light distribution pattern can be determined relatively easier because a designing means that is similar to a filament in a C-8 halogen lamp is available.

Figure 6:
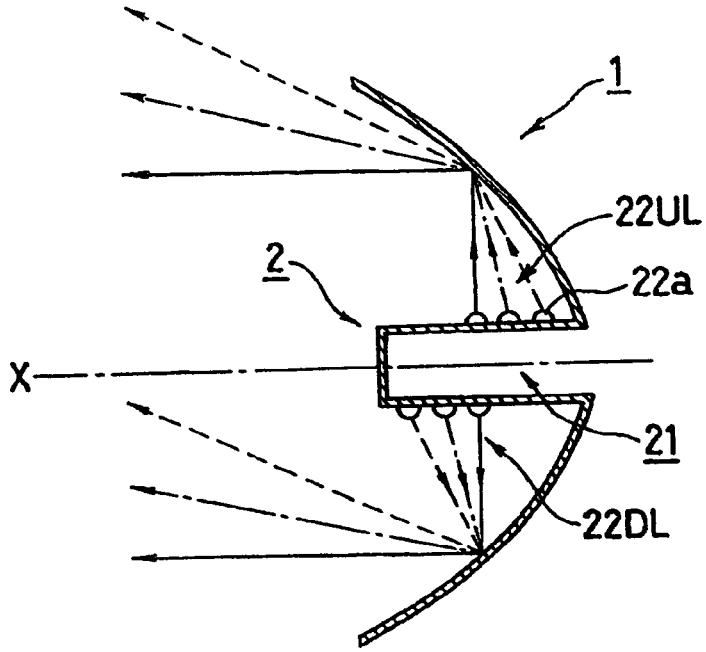
FIG. 6 is a cross-sectional view of another embodiment of a vehicle lamp made in accordance with the principles of the invention.

FIG. 6 shows another preferred embodiment of the invention, formed as a vehicle lamp 1 made in accordance with the principles of the present invention. This figure shows the LED arrays 22UL and 22DL located on the upper and lower sides of the light source holder 21. In the previous embodiment, the LED array 22U is located in such a range of position that the LED array 22U can provide light that illuminates below the horizontal line after being reflected by the reflective surface 3U. The LED array 22D is also located in such a range of position that the LED array 22D can provide light that illuminates below the horizontal line after being reflected by the reflective surface 3D.

To the contrary, in the lamp of FIG. 6, the LED array 22UL is provided with additional LED chips 22*a* that are located at positions such that they can provide an illuminating light at a slightly upward orientation relative to the horizontal line. At least the LED chips 22*a* that are located in the additional region can be selectively turned on/off using an appropriate means such as a beam selector switch. Additional LED chips 22*a* may also be provided for the LED array 22DL which can similarly be selectively turned on/off, if required or desired.

Figure 7:
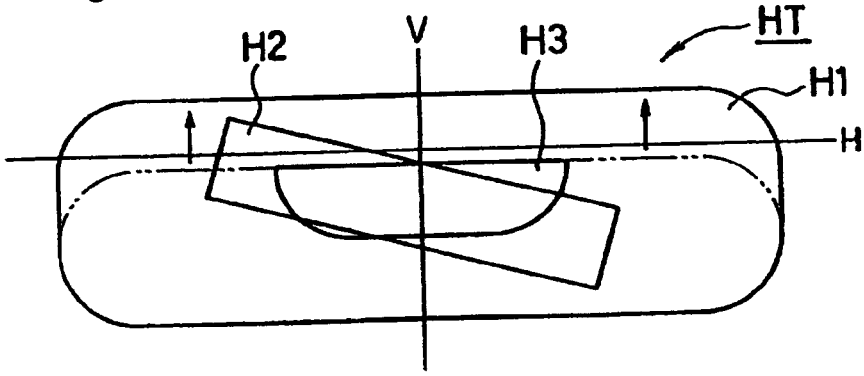
FIG. 7 is an illustrative view showing a formation of light distribution patterns for the vehicle lamp of FIG. 6.

Thus, when the beam selector switch is operated, for example, to turn on the additional LED chips 22*a*, a light traveling toward the horizontal front direction is added to the low beam distribution pattern described in the embodiment shown in FIG. 1. As a result, a high beam distribution pattern can be provided as shown in FIG. 7. The beam selector switch can be conveniently located near the driver's seat.

In practical use, when the high beam distribution pattern is selected, the road surface immediately before the vehicle is brightly illuminated, which can reduce the driver's visual sensitivity and can reduce distance visibility. Therefore, it can be further effective to control the LED arrays 22UL and 22DL to turn off the LED chips 22*a* that illuminate the road immediately in front of the vehicle when the beam selector switch is operated.

Although FIG. 6 is described as a vertical cross-sectional view of a vehicle lamp 1, it can also be seen as a horizontal cross-sectional view. In this case it can be understood that the light is directed in the lateral direction when the additional LED array 22 is turned on. Accordingly, if the additional LED array 22 is turned on/off in accordance with handling of a steering wheel, for example, the so-called cornering lamp can be provided.

Figure 8:
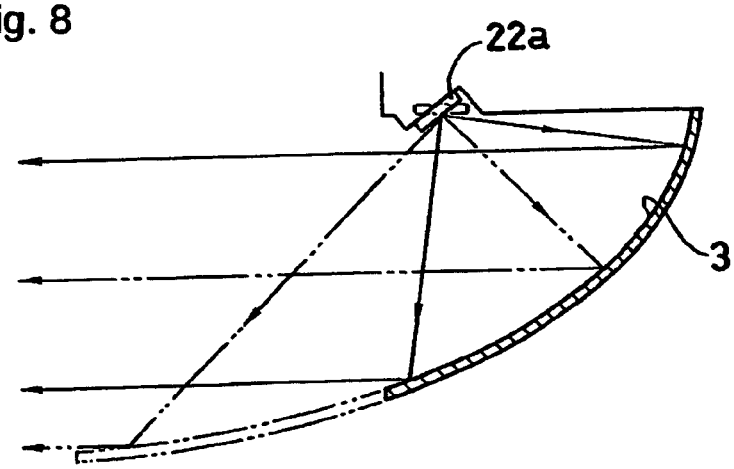
FIG. 8 is cross-sectional view of another embodiment of a vehicle lamp made in accordance with the principles of the invention.

FIG. 8 shows another preferred embodiment of the invention, formed as a vehicle lamp 1 made in accordance with the principles of the present invention. In any one of the previous preferred embodiments, the LED array 22 can be mounted on a side 21*a* that is parallel with the optical axis X. The LED chip 22*a*, however, can emit a light having a half emission angle of 45° or more. Therefore, to capture the light, the reflective surface 3 should also extend forward, resulting in an increased diameter and depth, which enlarges the vehicle lamp 1.

In the vehicle lamp 1 of FIG. 8, therefore, when a plurality of LED chips 22*a* are employed to configure an LED array 22, the LED chips 22*a* can be tilted backward individually to reduce the depth of the reflective surface 3. This is effective to reduce the diameter and downsize the vehicle lamp 1 as a whole without reducing the amount of illumination.

The number of combinations of the LED arrays and reflective surfaces is not limited to the above described embodiments. If a larger amount of light is required, the light source holder 21 may have an altered number of sides such as to be shaped in a hexagonal prism or an octagonal prism to increase the number of LED chips. Alternatively, if the light distribution pattern is not required to be complicated in shape, the LED arrays can be arranged only on any two of the sides 21*a* formed on the light source holder 21, and the reflective surfaces 3 may include two corresponding surfaces.

Figure 9:
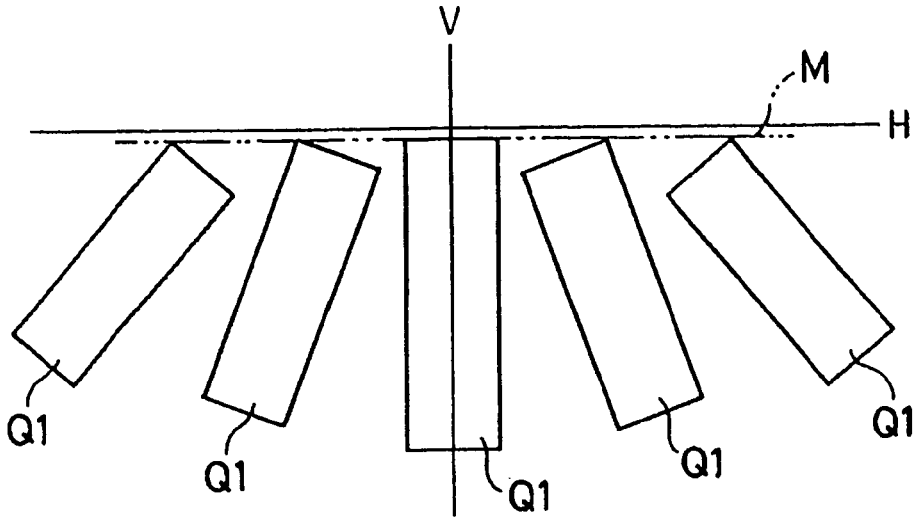
FIG. 9 is an illustrative view schematically showing a light distribution pattern formed by an upper LED array and an upper reflective surface for the vehicle lamp of FIG. 1.

FIG. 9 schematically shows a projection of the LED array 22U from the reflective surface 3U of the light source 2 for the vehicle lamp 1 shown in FIG. 4. The LED array 22U can be arranged on the side 21*a* of the light source holder 21 such that the longitudinal direction is located along the optical axis X. Accordingly, a projected image Q1 of the LED array is an image projected at an angle of 45-90° to the horizontal line H. This configuration for the projection of light is similar for the combination of the reflective surface 3D and the LED array 22D.

A study of the projection of the LED array 22U finds that the projected images of the LED array 22U concentrate the shorter sides of the LED array 22U in the vicinity of the horizontal line H, as obvious from FIG. 9. In a practical light distribution characteristic, a light/dark boundary in a low beam distribution, provided by the combination of the LED array 22U and the reflective surface 3U and the combination of the LED array 22D and the reflective surface 3D, is formed as a set of the shorter sides along the line denoted with the reference symbol M in FIG. 9.

In this case, the light/dark boundary in the low beam distribution should have a large light/dark contrast. When a large light/dark contrast is achieved, it is possible to ensure visibility for forward distances for a driver in a vehicle equipped with this vehicle lamp. The light that is produced does not dazzle or produce glaring light on a driver in an oncoming vehicle. It is difficult, however, for the light/dark boundary composed of the set of the shorter sides of the LED array 22U as described above to ensure a sufficient light/dark contrast.

Figure 10:
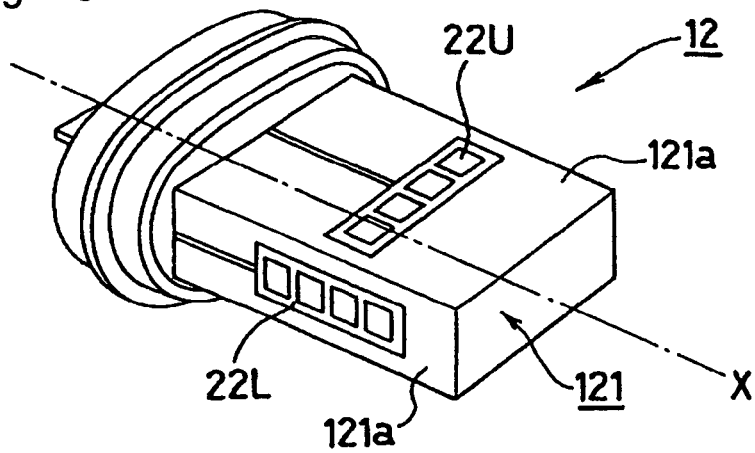
FIG. 10 is a perspective view showing an embodiment of a light source holder for a vehicle lamp made in accordance with the principles of the present invention.

A light source 12 made in accordance with the principles of the invention and configured as shown in FIG. 10 can be provided to provide greater light/dark contrast. In the light source 12, an LED array 22 can be attached to a light source holder 121 on a side 121*a*. The image of the LED array 22 can be reflected from the corresponding reflective surface 3 and projected in the illumination direction. In this case, a basic projected image of the LED array preferably has a longitudinal direction that is in parallel with the horizontal line.

The above configuration is described with reference to the light source holder 12 specifically shaped in a quadrangular prism. The LED array 22U can be attached to the upper side 121*a* of the light source holder 12. In this case, the image projected in the illumination direction from the reflective surface 3U corresponding to the LED array 22U can be shaped to have the longitudinal direction parallel with the horizontal line, that is, perpendicular to the optical axis X. As for the LED array 22D attached to the lower side, it ca be similarly attached perpendicular to the optical axis X.

As for the LED array 22L (R) attached to the standing side 121*a*, the image projected in the illumination direction from the reflective surface 3L (R) corresponding to the LED array 22L (R) can be shaped to have the longitudinal direction parallel with the horizontal line. In this case, the LED array 22L (R) preferably has a direction parallel with the optical axis X.

Figure 11:
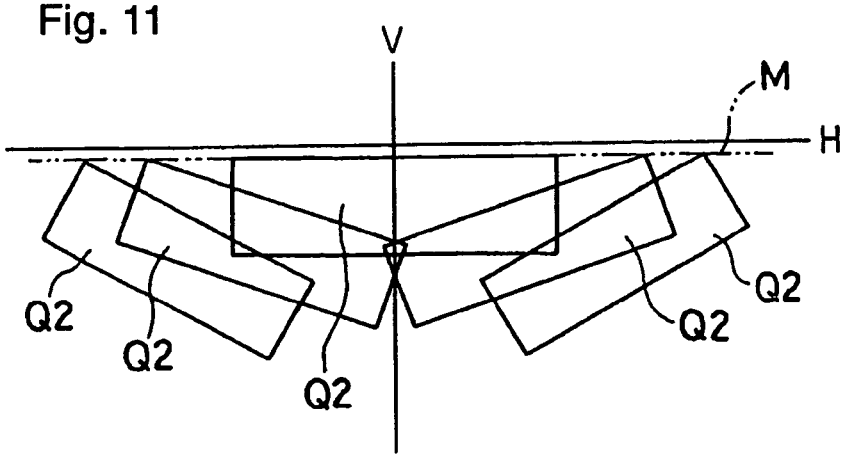
FIG. 11 is an illustrative view schematically showing a light distribution pattern formed by an upper LED array and an upper reflective surface for the light source holder of FIG. 10.

FIG. 11 schematically shows projected images formed by the combination of the LED array 22U (D) and the reflective surface 3U (D). The light/dark boundary M is formed as a set of longer sides of projected images Q2 of the LED array 22U (D). This configuration is effective in that it provides a large light/dark contrast on the light/dark boundary and provides improved performance.

As described above, one LED array 22 preferably corresponds to one reflective surface 3. Therefore, the longitudinal direction of the LED array 22 is adjusted in consideration of the tilt of the reflective surface 3 when the LED array 22 is located on the light source holder 21. This is effective to adjust the shape of the light distribution characteristic and the distribution of the luminous intensity and to easily achieve a characteristic suitable for use with a particular vehicle lamp 1.

Figure 12:
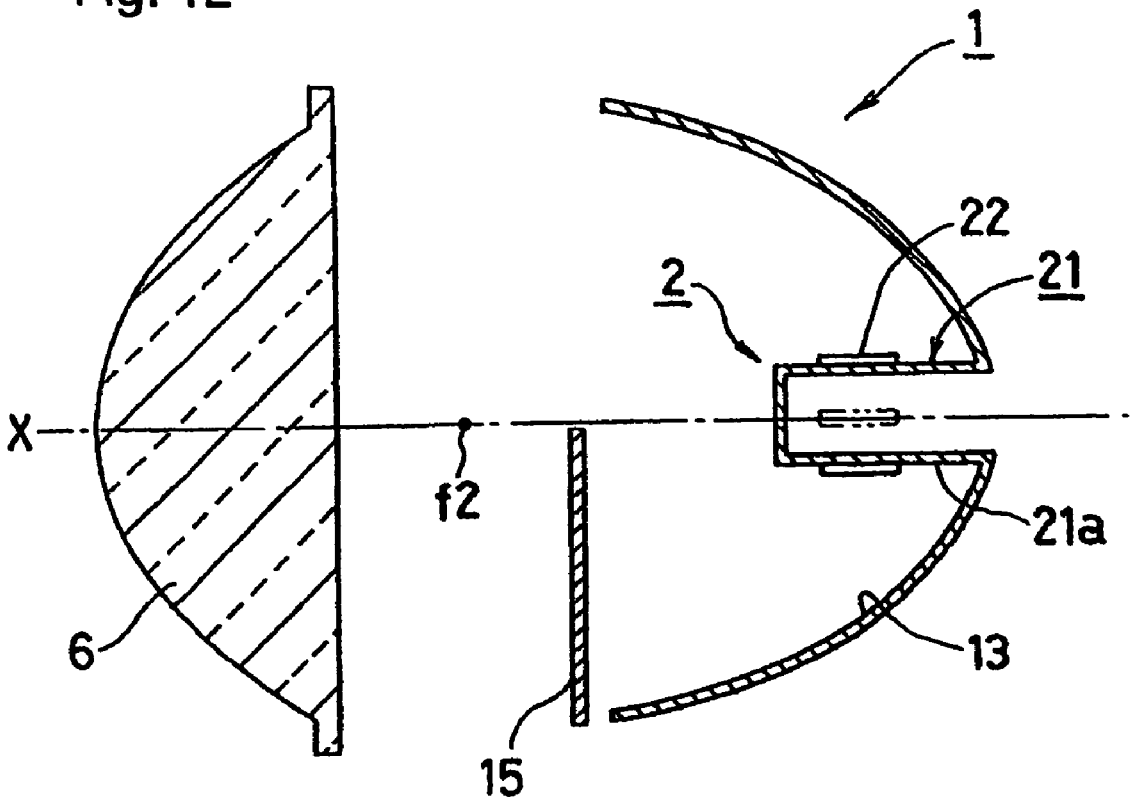
FIG. 12 is a cross-sectional view showing another embodiment of a vehicle lamp made in accordance with the principles of the present invention.

FIG. 12 shows another preferred embodiment of the invention. In the previously described preferred embodiments, the reflective surface 3 is described as a parabolic reflective surface such as a paraboloid of revolution. The present invention is not limited only to such examples. In this embodiment, the reflective surface 3 that is to be combined with the light source 2 which includes the LED array 22 (see FIG. 2) can be shaped in an elliptic reflective surface such as an ellipsoid of revolution that is obtained by revolution of an ellipse about its major axis.

In this case, each reflective surface 13 can have a first focus at a corresponding LED array 22. The reflective surfaces 13 can have a second focus f2 at a point on the optical axis X. This configuration is only basic and, depending on, for example, the shape of the light distribution characteristic to be formed, each reflective surface 13 may individually have the second focus f2 at a different location.

The vehicle lamp 1 of FIG. 12 is of the so-called projector type. Therefore, a shade 15 is preferably located near the second focus f2, and a projection lens 6 can have a focus in the vicinity of the shade 15 and can be located in front of the shade 15.

The above configuration can form a beam of lights that are reflected from the four reflective surfaces 13 and converge on the second focus f2. A substantially lower half of this beam when viewed in section is blocked at the shade 15 to produce a quarter semicircle or other shape. The quarter semicircle is reversed and projected forward through the projection lens 6 to form an illuminating light having a light distribution characteristic as required or desired for the vehicle lamp 1.

When an arrangement of the LED arrays on the light source holder is appropriately matched with the combined reflective surface, the shape of the light distribution characteristic and the distribution of the luminous intensity can be freely controlled. Therefore, the present invention is applicable for use when intensive illumination of particular areas is desired, for example, for road illumination.

Having described preferred embodiments consistent with the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. A vehicle lamp for emitting light and forming a predetermined light distribution pattern, comprising:

a plurality of light sources;

a plurality of corresponding reflective surfaces, wherein each of said light sources includes at least one LED array with LED chips arranged in a row, and each of said reflective surfaces is arranged in combination with one of said light sources to generate light beams each having a certain light distribution pattern, the lights sources and reflective surfaces configured such that each of the light beams having a certain light distribution pattern are superimposed with each other to form said predetermined light distribution pattern; and a light source holder shaped in a substantially polygonal form having sides and a longitudinal axis in a direction that is substantially parallel with an optical axis of said lamp, wherein a first side includes at least a first LED array with the LED chips arranged in a row that extends substantially parallel to the optical axis and a second side includes at least a second LED array with the LED chips arranged in a row that extends substantially perpendicular to the optical axis.

2. The vehicle lamp according to claim 1, wherein each side of said light source holder has one of said at least one LED array arranged thereon and wherein said reflective surfaces are located such that they surround said light source holder.

3. The vehicle lamp according to claim 1, wherein each side of the light source holder has one of said at least one LED array arranged thereon, and wherein the at least one LED array is arranged in a row direction such that a projected image of a light distribution pattern formed by light reflected from a corresponding one of said reflective surfaces has a longitudinal axis in a direction substantially perpendicular to the optical axis.

4. The vehicle lamp according to claim 1, further comprising:

a shade configured to block a part of light emitted from one of said light sources and arranged in the vicinity of said one of said light sources and in an optical path extending from said one of said light sources to one of said reflective surfaces to form the predetermined light distribution pattern.

5. A vehicle lamp for emitting light and forming a predetermined light distribution pattern, comprising:

a plurality of light sources;

a plurality of corresponding reflective surfaces, wherein each of said light sources includes at least one LED array with LED chips arranged in a row, and each of said reflective surfaces is arranged in combination with one of said light sources to generate light beams each having a certain light distribution pattern, the light sources and reflective surfaces configured such that each of the light beams having a certain light distribution pattern are superimposed with each other to form said predetermined light distribution pattern;

a light source holder shaped in a substantially polygonal form having sides and a longitudinal axis in a direction that is substantially parallel with an optical axis of said lamp, wherein at least two of the sides each includes at least one of said plurality of light sources; and a shade located in a lateral direction from the light source holder, the shade having the shape of a plate and having a longitudinal axis and the longitudinal axis forming an angle between 0° and 90° with respect to the optical axis of the lamp and the shade being located between at least one of the plurality of light sources and a projection lens, and wherein each reflective surface has a first focal point at a corresponding LED array and a second focal point in the vicinity of a focus of the projection lens.

6. The vehicle lamp according to claim 1, wherein said vehicle lamp is configured such that one of a number and a position of said LED chips to be turned on in each LED array or between LED arrays can be varied such that said predetermined light distribution pattern can be varied.

7. The vehicle lamp according to claim 1, wherein one of, said LED array and one of said LED chips, is tilted with respect to an optical axis of the lamp so as to direct light to one of said reflective surfaces.

8. The vehicle lamp according to claim 2, further comprising:

a shade configured to block a part of light emitted from one of said light sources and arranged in the vicinity of said one of said light sources and in an optical path extending from said one of said light sources to one of said reflective surfaces to form the predetermined light distribution pattern.

9. The vehicle lamp according to claim 3, further comprising:

a shade configured to block a part of light emitted from one of said light sources and arranged in the vicinity of said one of said light sources and in an optical path extending from said one of said light sources to one of said reflective surfaces to form the predetermined light distribution pattern.

10. The vehicle lamp according to claim 2, wherein at least one of said LED arrays includes a cylindrical lens having a longitudinal axis in a row direction of said at least one LED array.

11. The vehicle lamp according to claim 3, wherein at least one of said LED arrays includes a cylindrical lens having a longitudinal axis in a row direction of said at least one of said LED arrays.

12. The vehicle lamp according to claim 4, wherein at least one of said LED arrays includes a cylindrical lens having a longitudinal axis in a row direction of said at least one of said LED arrays.

13. The vehicle lamp according to claim 5, wherein at least one of said LED arrays includes a cylindrical lens having a longitudinal axis in a row direction of said at least one of said LED arrays.

14. The vehicle lamp according to claim 2, wherein said vehicle lamp is configured such that one of a number and a position of said LED chips to be turned on in each LED array or between LED arrays can be varied such that said predetermined light distribution pattern can be varied.

15. The vehicle lamp according to claim 3, wherein said vehicle lamp is configured such that one of a number and a position of said LED chips to be turned on in each LED array or between LED arrays can be varied such that said predetermined light distribution pattern can be varied.

16. The vehicle lamp according to claim 4, wherein said vehicle lamp is configured such that one of a number and a position of said LED chips to be turned on in each LED array or between LED arrays can be varied such that said predetermined light distribution pattern can be varied.

17. The vehicle lamp according to claim 5, wherein said vehicle lamp is configured such that one of a number and a position of said LED chips to be turned on in each LED array or between LED arrays can be varied such that said predetermined light distribution pattern can be varied.

18. The vehicle lamp according to claim 2, wherein one of, said LED array and one of said LED chips, is tilted with respect to an optical axis of the lamp so as to direct light to one of said reflective surfaces.

19. The vehicle lamp according to claim 3, wherein one of, said LED array and one of said LED chips, is tilted with respect to an optical axis of the lamp so as to direct light to one of said reflective surfaces.

20. The vehicle lamp according to claim 4, wherein one of, said LED array and one of said LED chips, is tilted with respect to an optical axis of the lamp so as to direct light to one of said reflective surfaces.

21. The vehicle lamp according to claim 5, wherein one of, said LED array and one of said LED chips, is tilted with respect to an optical axis of the lamp so as to direct light to one of said reflective surfaces.

22. The vehicle lamp according to claim 6, wherein one of, said LED array and one of said LED chips, is tilted with respect to an optical axis of the lamp so as to direct light to one of said reflective surfaces.

23. An LED type lamp, comprising:

a light source including at least three LED arrays, each LED array including a row of LED chips formed thereon, wherein at least one row of LED chips extends substantially perpendicular to an optical axis of the LED type lamp, wherein at least one of the at least three LED arrays is capable of being tilted backward individually to reduce the depth of the reflective surface and wherein light emitted from the at least three LED arrays is substantially perpendicular to the optical axis of the LED type lamp;

at least three reflector surfaces located adjacent said at least three LED arrays, respectively, each of said reflector surfaces being configured to direct light emitted from one of said at least three LED arrays into a certain light distribution pattern such that the at least three reflector surfaces produce a plurality of certain light distribution patterns, and said plurality of certain light distribution patterns combine to form a predetermined light distribution pattern.

24. The LED type lamp of claim 23, further comprising:

a light source holder located adjacent said plurality of reflectors and having a plurality of sides extending in a direction parallel to an optical axis of the LED type lamp, wherein at least one of said LED arrays is located adjacent at least one of said plurality of sides.

25. An LED type lamp having an optical axis along which a light beam can be emitted, comprising:

a plurality of light sources including at least one row of LED chips;

a reflector located adjacent the light sources; and a light source holder including at least three surfaces that each extend substantially parallel to the optical axis of the LED type lamp, the at least three surfaces extending away from a back surface of the reflector, wherein the at least one row of LED chips is arranged substantially perpendicular to the optical axis along one of the at least three surfaces and wherein light emitted from the at least one row of LED chips is emitted along a direction substantially perpendicular to the optical axis of the LED type lamp, and wherein at least one row of LED chips is offset from an adjacent row of LED chips in a longitudinal direction with respect to each other.

26. The LED type lamp of claim 25, wherein each of the light sources includes a plurality of LED chips and the at least three surfaces extend along the optical axis of the lamp, each of said surfaces including at least one of said plurality of LED chips located thereon, and said reflector including a plurality of different shaped reflective surfaces each corresponding to a different one of said surfaces of said light source holder.

* * * * *